US007699286B2

(12) United States Patent
Brinkman et al.

(10) Patent No.: US 7,699,286 B2
(45) Date of Patent: Apr. 20, 2010

(54) LABEL HOLDER FOR A SHELF PRICE CHANNEL

(75) Inventors: Michael Brinkman, Belvidere, IL (US); Kirk Lewis, Lee's Summit, MO (US)

(73) Assignee: Southern Imperial, Inc., Rockford, IL (US)

( * ) Notice: Subject to any disclaimer, the term of this patent is extended or adjusted under 35 U.S.C. 154(b) by 1367 days.

(21) Appl. No.: 10/743,215

(22) Filed: Dec. 22, 2003

(65) Prior Publication Data

US 2005/0133676 A1 Jun. 23, 2005

(51) Int. Cl.
*G09F 3/18* (2006.01)

(52) U.S. Cl. ..... 248/489; 248/316.7; 40/649

(58) Field of Classification Search ..... 248/489, 248/316.7, 316.1; 40/649, 658
See application file for complete search history.

(56) References Cited

U.S. PATENT DOCUMENTS 5,263,269 A * 11/1993 Tjarnlund ..... 40/5
5,488,793 A * 2/1996 Gebka et al. ..... 40/661.03
5,899,011 A * 5/1999 Brinkman ..... 40/661.03
6,026,603 A * 2/2000 Kump et al. ..... 40/661.03
6,105,295 A 8/2000 Brinkman et al.
D432,177 S 10/2000 Wildrick
D443,311 S * 6/2001 Wildrick ..... D20/43
6,263,603 B1 7/2001 Wildrick
6,269,571 B1 8/2001 Thalenfeld
D454,163 S 3/2002 Nagel
6,357,154 B1 * 3/2002 Pfendler et al. ..... 40/661.03
D461,507 S 8/2002 Nagel
6,430,857 B1 8/2002 Nagel
6,470,613 B1 * 10/2002 Wildrick ..... 40/661.03
6,553,702 B1 * 4/2003 Bacnik ..... 40/661.03
6,688,567 B2 * 2/2004 Fast et al. ..... 248/220.41
6,708,436 B2 * 3/2004 Nagel ..... 40/661.01
6,779,771 B2 * 8/2004 Ostrovsky et al. ..... 248/316.7

* cited by examiner

*Primary Examiner*—J. Allen Shriver, II
*Assistant Examiner*—Steven M Marsh
(74) *Attorney, Agent, or Firm*—Reinhart Boerner Van Deuren P.C.

(57) ABSTRACT

A label holder is provided for mounting on a shelf channel. The label holder includes a front panel, a back panel connected to the front panel with a common bottom edge with a cavity there between. The label holder also has a protective flange along a top edge of the back panel and a shelf clip portion separated from the back panel by a common top edge. The shelf clip portion includes an upward retaining flange for engaging the shelf and includes a downward angled engaging portion terminating in a catch flange and a curved resilient hinge portion that is configured to encompass the catch flange and terminate in an upward flange. The shelf clip portion provides resilient clamping onto the shelf. The catch flange is configured to engage a lower shelf channel flange as the curved resilient hinge wraps an arcuate channel of the shelf.

15 Claims, 4 Drawing Sheets

LABEL HOLDER FOR A SHELF PRICE CHANNEL

FIELD OF THE INVENTION

The present invention relates generally label holder, and, more particularly, relates to a label holder for attachment to a shelf price channel.

BACKGROUND OF THE INVENTION

This invention relates to a label holder for mounting on channels of shelves for shelf units and the like. Typical shelf units are Lozier or Madix brand shelving units that provide arcuate shelf channels (a.k.a. "C-channels") for holding product information labels or for holding label holders for replaceable labels that are insertable into a clear sleeve. Label holders are typically extruded from a resilient plastic and include at least a clear front panel behind which a product information label can be inserted. Known label holders can be difficult to install and if they are easy to install, they may be unstable or subject to dislodging. What is needed is an improved label holder design with ease of installation and robust stability.

BRIEF SUMMARY OF THE INVENTION

The invention provides an improved label holder mountable on a shelf channel. The label holder includes a front panel, a back panel connected to the front panel along a common bottom with a label receptacle cavity therebetween. The label holder also has a top flange along a top of the back panel and a shelf clip portion attached to the back panel along the top flange. The shelf clip portion includes an upward retaining flange for engaging the shelf and includes a downward angled portion terminating in a catch flange and a curved resilient hinge portion that wraps around the catch flange and terminates in an upward flange. The shelf clip portion provides resilient clamping onto the shelf. The upward and catch flanges are configured to engage upper and lower shelf channel flanges for retention.

Another embodiment is directed to a label holder mounted on the C-channel of a shelf, in which the C-channel includes a top support flange, an inwardly curving support panel and a lower support flange. The label holder includes a front translucent panel, a back panel connected to the front panel along a bottom portion, said front panel and said back panel forming a cavity therebetween, and a protective flange is provided along a top portion of the back panel. The label holder also includes a shelf clip portion with an upward retaining flange for engaging the top support flange of said shelf and a downward angled portion terminating in a catch flange secured by the lower support flange of the shelf and a curved resilient hinge portion that wraps around the catch flange and engages the back side of curved shelf panel of the C-channel. The retaining flange can be configured to respond to upward movement of the back panel to secure the retaining flange against the shelf.

Other aspects, objectives and advantages of the invention will become more apparent from the following detailed description when taken in conjunction with the accompanying drawings.

DETAILED DESCRIPTION OF THE INVENTION

Figure 1:
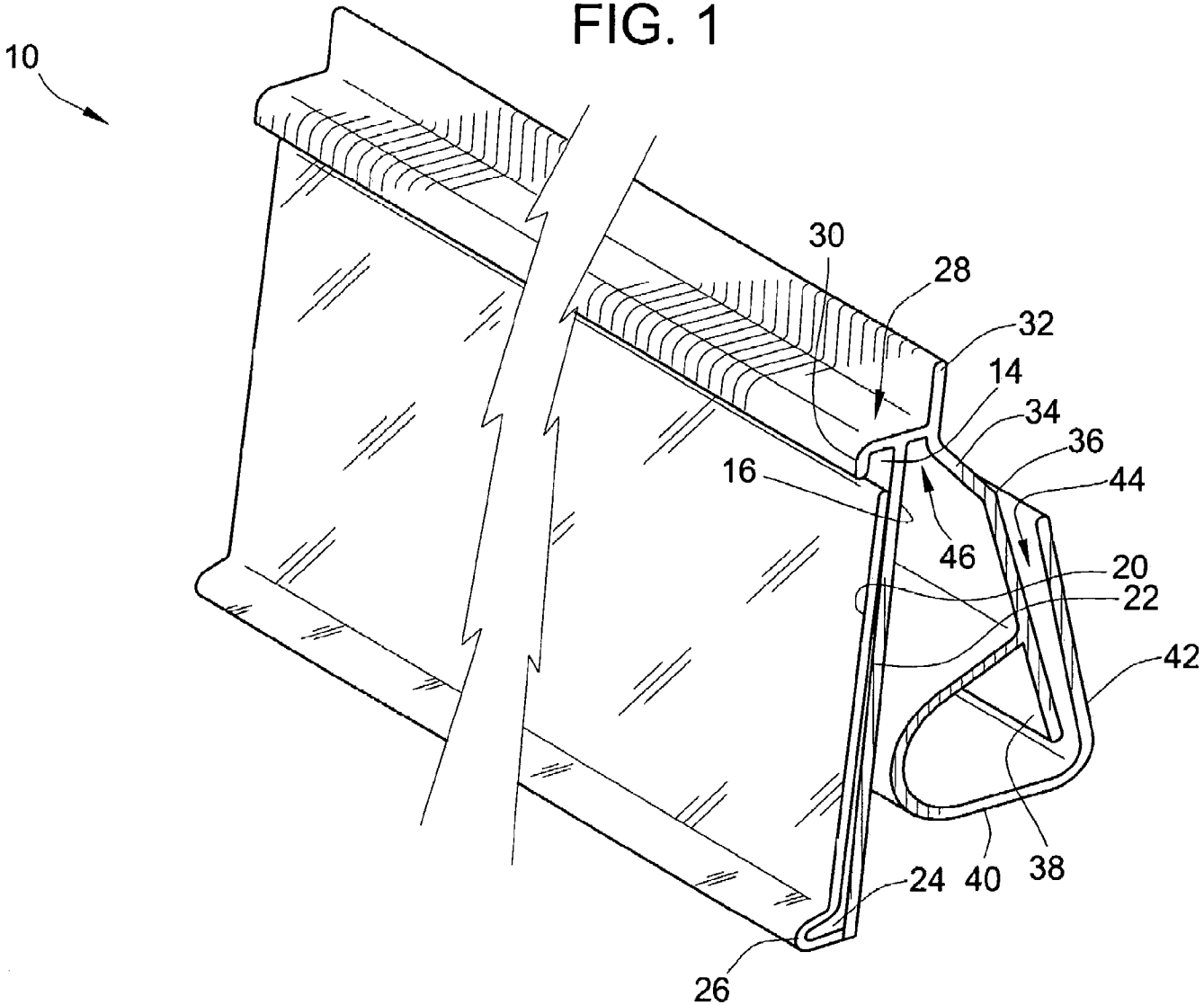
FIG. 1 is a perspective view, taken from the front and right, of one embodiment of the label holder constructed in accordance with the teachings of the present invention.
Figure 2:
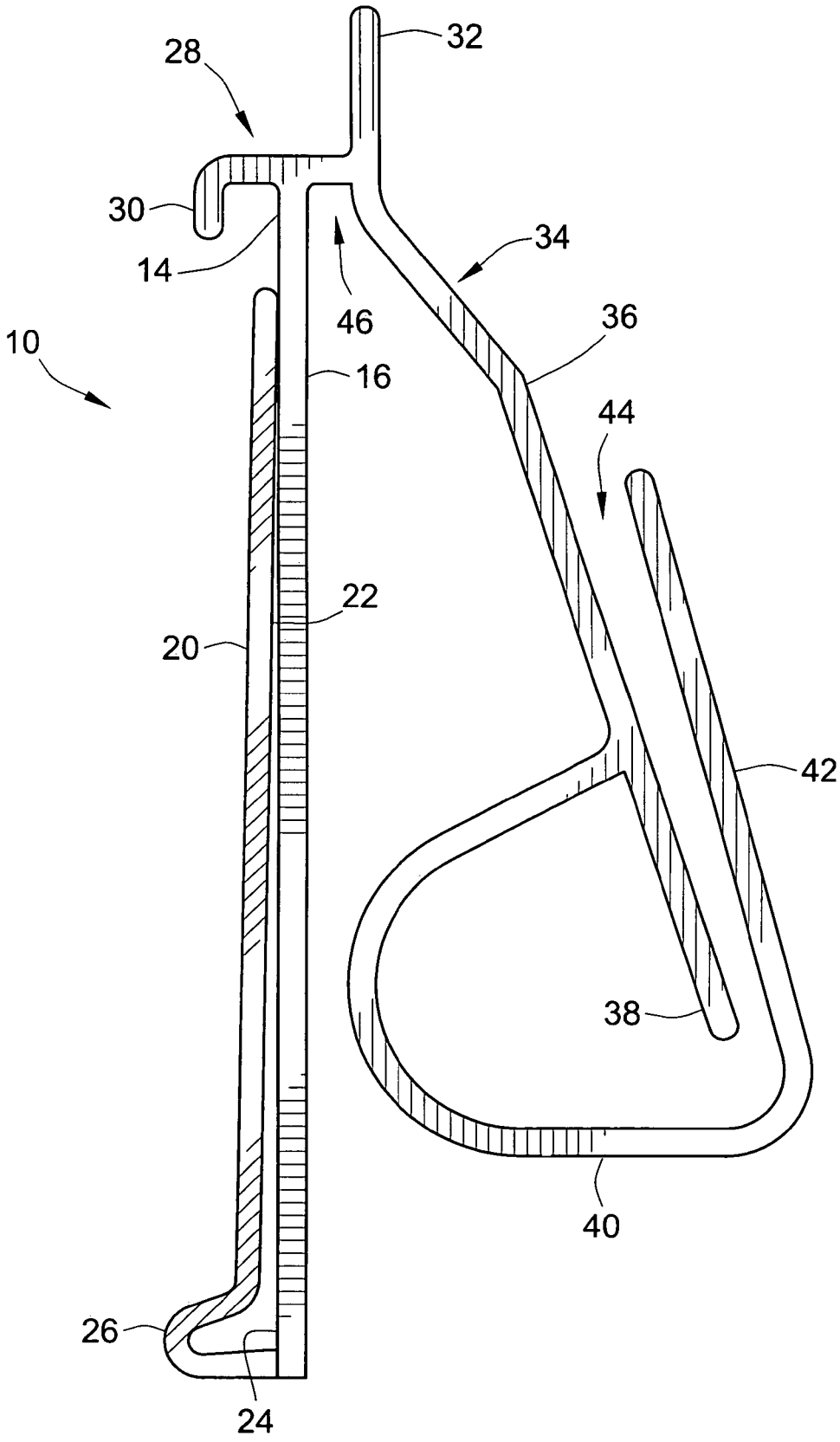
FIG. 2 is a side view of the label holder in accordance with the teachings of the present invention.

Turning now to the drawings, an embodiment of the present invention is depicted in FIGS. 1 and 2. The label holder 10 depicted in FIGS. 1 and 2 illustrates a label holder appropriate for insertion into a shelf channel. FIG. 1 illustrates a perspective view showing that the length of label holder 10 can vary as shown by the jagged severance lines. FIG. 2 illustrates a side view of label holder 10 illustrating that label holder 10 can be extruded plastic, such as an appropriate plastic material such as polyvinyl chloride, co-extruded polyvinyl chloride, butryrate, provista or acrylonitrile butadiene styrene (ABS). The label holder can be approximately between 1 and 1½ inches in height. As shown in FIG. 2, label holder 10 includes rear panel 16 and front panel 20 that are joined along a common bottom 24. Front panel 20 can include a forward guide flange 26 that projects forwardly from the bottom 24. Common bottom 24 can join the co-extruded plastic material of either translucent front 20 with an opaque rear panel 16, or a translucent front 20 with a translucent rear panel 16. Front panel 20 and rear panel 16 are substantially parallel but slightly canted to provide a cavity 22 that is wider near the common bottom 24 and contact or almost contact at a top edge of the front panel 20. The cavity 22 enables receiving the product information labels. The rear panel 16 extends above the front panel and includes a protective top flange 28 that extends forwardly and curves downward with a downward edge 30. The back panel 16 and the downward edge 30 form a channel 14. Protective top flange 28 also extends backwardly from back panel 16 to meet shelf clip portion 34. Shelf clip portion 34 includes an upward retaining flange 32 for engaging a shelf channel. Shelf clip portion 34 also includes a downward angled portion 36 terminating in a catch flange 38. The downward angle can be approximately 20 degrees. Downward angled portion 36 supports a curved flexible hinge portion 40 that extends downwardly from downward angled portion 36 and around catch flange 38 to form an upwardly extending flange 42. Upwardly extending flange 42 and downward angled engaging portion 36 are about parallel but slightly canted relative to each other in the relaxed state and form a cavity 44 therebetween. Curved resilient portion 40 and upwardly extending flange 42 together form an expandable hinge that expands for attachment to a shelf channel.

Figure 3:
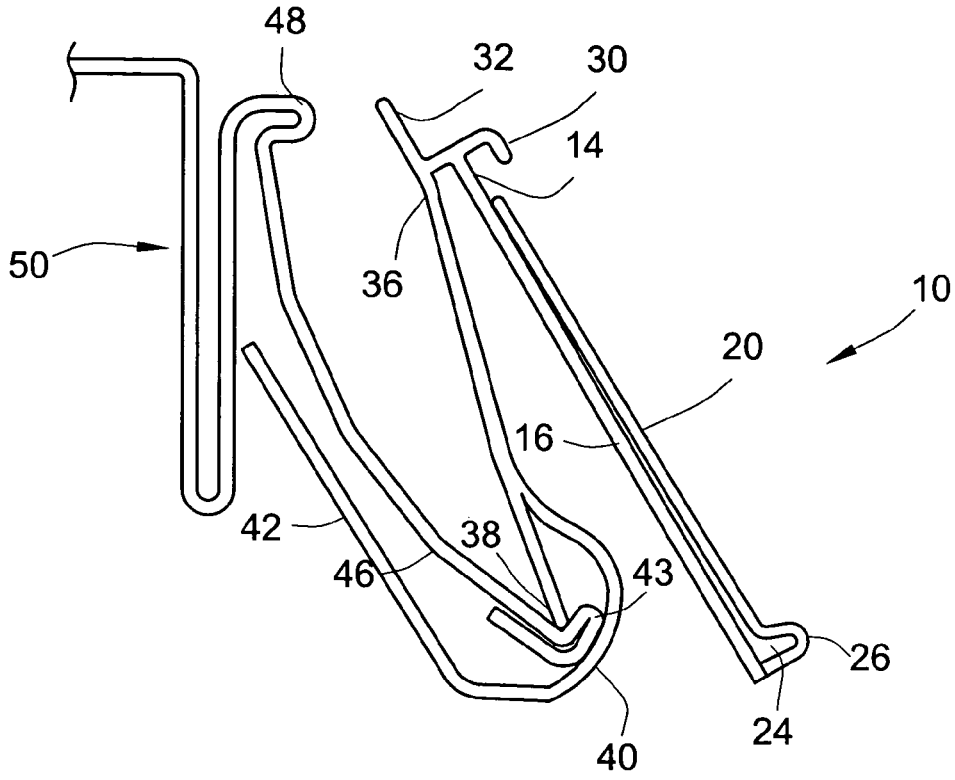
FIG. 3 is a side view of the label holder illustrating an initial step for insertion of the label holder onto a shelf channel in accordance with the teachings of the present invention.

Referring now to FIG. 3, a Lozier brand shelf channel 50 is illustrated (other shelf channel brands may be used including but not limited to Madix brand) with the label holder 10 being inserted thereon. The shelf channel 50 includes a protruding forward flange 48 that curves downwardly into an inwardly curving arcuate panel 46 and terminating with a forward protruding flange 43.

Figure 4:
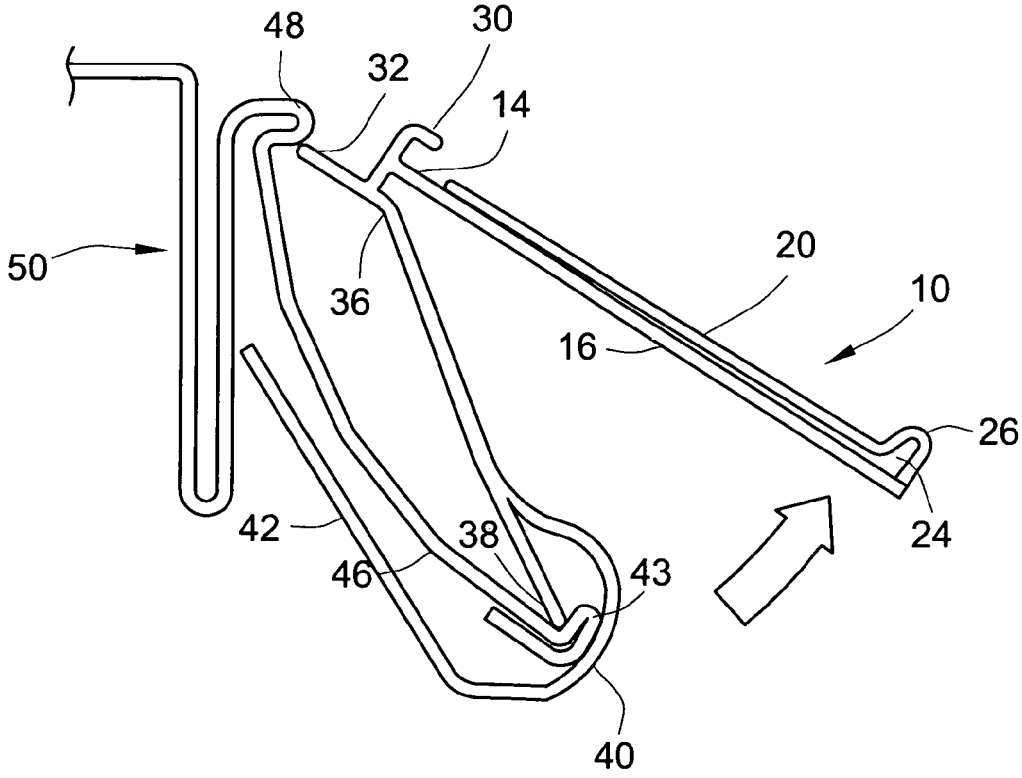
FIG. 4 is a side view of the label holder illustrating an intermediate step for insertion of the label holder onto a shelf channel in accordance with the teachings of the present invention.
Figure 5:
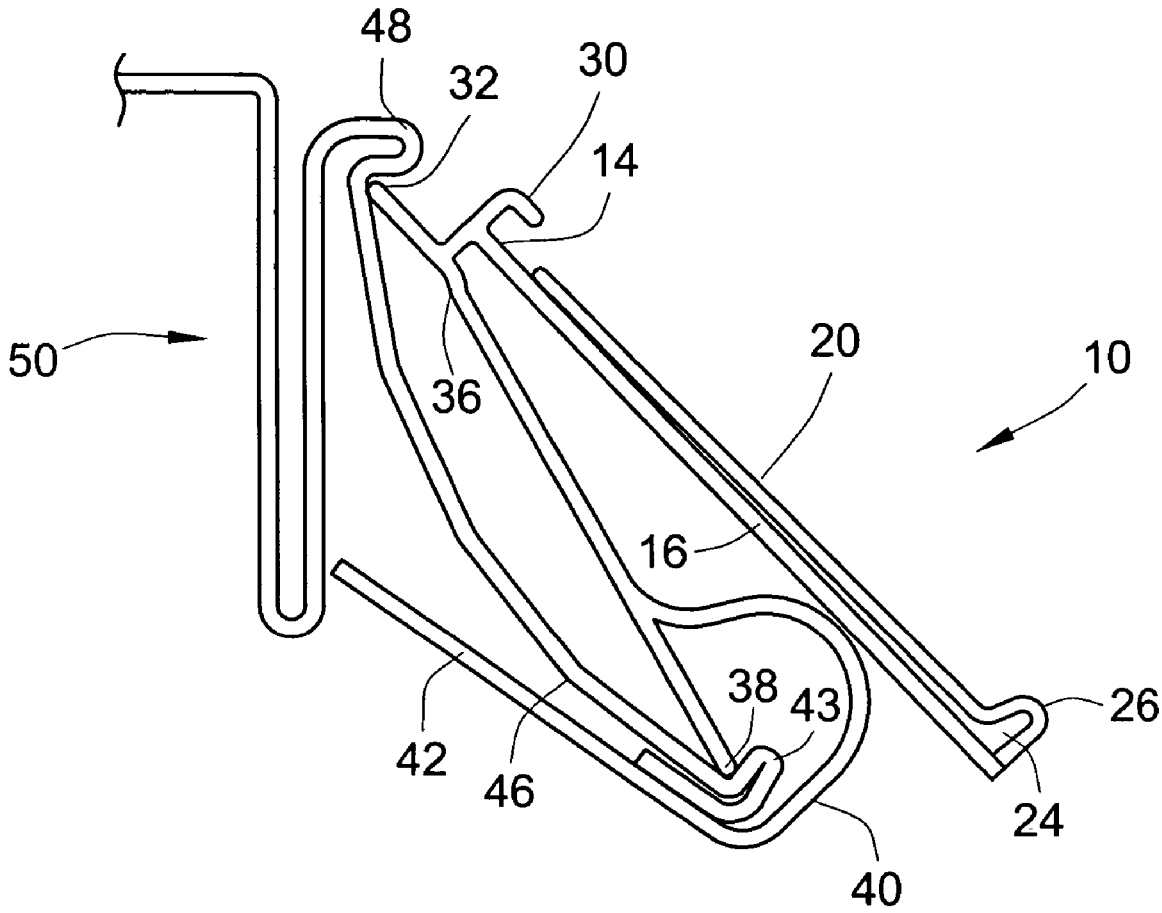
FIG. 5 is a side view of the label holder illustrating a final step for insertion of the label holder onto a shelf channel in accordance with the teachings of the present invention.

FIG. 3 illustrates an initial step for inserting the label holder onto the shelf 50. It will be recognized that there are a number of different ways to insert label holder 10 onto a shelf channel and FIGS. 3 through 5 are merely exemplary in nature. In one method for inserting the label holder 10, the catch flange 38 is installed into its seat along bottom shelf flange 38 and the upwardly extending flange 42 is wrapped around the bottom of the shelf channel 50 which is allowed due to the resilient flexing and expansion of flexible hinge portion 40. Flange 42 is urged onto the shelf channel 50 by flexing flange 42 around protruding bottom shelf flange 43. Flange 42 can be of varying lengths which, as one of skill in the art will appreciate, can depend on the type of shelf channel, the size of the shelf channel and the like. FIG. 4 illustrates an intermediate step for inserting label holder 10. After flange 42 is urged around flange 48, upper retaining flange 32 is installed into and seated against upper shelf flange 48. FIG. 5 illustrates a final step toward inserting label holder 10 onto a shelf channel. As shown, the label holder 10 relaxes and is snapped into position by returning substantially to its original shape. To assist in this maneuver the back panel 16 can be pivoted upwardly and forwardly, which in turn causes the upper flange 32 to pivot. This decreases the spacing between the tip edges of the two mounting flanges 32, 38 and thereby eases installation into the C-channel. Once installed, and the label holder relaxes, flange 38 remains secured by bottom flange 43 of the shelf channel and flange 32 remains secured by upper flange 48.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A label holder for attachment to a shelf, the label holder comprising:

a front panel;

a back panel connected to the front panel along a bottom portion thereof, said front panel and said back panel forming a cavity therebetween; wherein the back panel is opaque, the label holder constructed as co-extruded polyvinyl chloride, butyrate, provista or acrylonitrile butadiene styrene(ABS), a top flange proximate a top portion of the back panel; and a shelf clip portion joined to the top flange and spaced rearward of the back panel, said shelf clip portion comprising an upward retaining flange for engaging the shelf and a downward angled portion terminating in a catch flange and a curved resilient hinge portion extended from the downward angled portion and wrapping around the catch flange to form an upward flange.

2. The label holder of claim 1 wherein said retaining flange pivots in response to upward pivoting movement of said back panel to secure said retaining flange against the shelf.

3. The label holder of claim 1 wherein said shelf clip portion provides resilient clamping onto the shelf, said catch flange configured to engage a lower shelf channel flange.

4. The label holder of claim 1 wherein said top flange is a protective flange extending forward from the back panel and having a downward depending edge.

5. The label holder of claim 1 wherein the downward angled engaging portion is angled at approximately 20 degrees from vertical.

6. The label holder of claim 1 wherein the label holder is constructed of one or more of polyvinyl chloride, butyrate, provista and acrylonitrile butadiene styrene (ABS).

7. The label holder of claim 1 wherein the label holder is translucent or partially translucent.

8. The label holder of claim 1 wherein a height of the label holder is approximately between 1 inch and 1½ inches.

9. The label holder of claim 1 wherein a height of the label holder is approximately between 3 inches and 4 inches.

10. A label holder mounted on a C-channel shelf having a top support flange, an inwardly curving panel and a lower support flange, the label holder comprising:

a front translucent panel;

a back panel connected to the front panel along a bottom portion thereof, said front panel and said back panel forming a cavity there between; and a shelf clip portion joined to a top portion of the back panel, the shelf clip portion comprising an upward retaining flange engaging the top support flange of said shelf and a downward angled portion terminating in a catch flange secured by the lower support flange of said shelf and a curved resilient hinge portion attached to the downward angled portion, the curved resilient hinge portion being wrapped around the lower support flange and engaging a back side of the inwardly curving panel.

11. The label holder of claim 10 wherein said retaining flange pivots in response to upward rotational movement of said back panel to secure said retaining flange against the shelf.

12. The label holder of claim 10 wherein the label holder is constructed of one or more of polyvinyl chloride, butyrate, provista and acrylonitrile butadiene styrene (ABS).

13. The label holder of claim 10 wherein said label holder has a height of approximately 1" and 1½".

14. The label holder of claim 10 further comprising a protective flange extending forwardly from the back panel with a downward depending edge.

15. The label holder of claim 10 wherein the downward angled engaging portion is angled at approximately 20 degrees from vertical.

* * * * *